US006179166B1

(12) United States Patent
Dallas, Jr.

(10) Patent No.: US 6,179,166 B1
(45) Date of Patent: Jan. 30, 2001

(54) ROD-SUPPORTABLE HANGING CONTAINER

(75) Inventor: Milton R. Dallas, Jr., East Troy, WI (US)

(73) Assignee: Seaquist Closures Foreign, Inc., Crystal Lake, IL (US)

( * ) Notice: Under 35 U.S.C. 154(b), the term of this patent shall be extended for 0 days.

(21) Appl. No.: 09/417,174

(22) Filed: Oct. 12, 1999

(51) Int. Cl.[7] ..... B67D 5/06

(52) U.S. Cl. ..... 222/181.1; 222/212; 222/494; 220/475

(58) Field of Search ..... 222/181.1, 181.2, 222/212, 494; 220/475, 771

(56) References Cited

U.S. PATENT DOCUMENTS

| | | | |
|---|---|---|---|
| D. 176,226 | | 11/1955 | Morris . |
| D. 196,390 | | 9/1963 | McDermott . |
| D. 211,933 | | 8/1968 | Horne . |
| D. 216,248 | | 12/1969 | Hills . |
| D. 221,517 | | 8/1971 | Luedtke . |
| D. 224,200 | | 7/1972 | Kretz . |
| D. 224,701 | | 9/1972 | Wright . |
| D. 224,905 | | 10/1972 | Brassart . |
| D. 242,772 | | 12/1976 | Marlow . |
| D. 244,176 | | 5/1977 | Pardo . |
| D. 254,235 | | 2/1980 | Hartung . |
| D. 271,746 | | 12/1983 | Pieri . |
| D. 273,940 | | 5/1984 | Soos et al. . |
| D. 274,888 | | 7/1984 | Lang . |
| D. 278,120 | | 3/1985 | Grant . |
| D. 279,256 | | 6/1985 | Lang . |
| D. 303,496 | | 9/1989 | Larson . |
| D. 304,806 | | 11/1989 | Mednis . |
| D. 321,130 | | 10/1991 | Goberman . |
| D. 371,479 | | 7/1996 | Hirst . |
| D. 373,536 | | 9/1996 | Kokenge . |
| D. 403,242 | | 12/1998 | Edwards . |
| D. 409,920 | | 5/1999 | Fenton et al. . |
| 3,243,074 | | 3/1966 | Rindner . |
| 3,920,140 | | 11/1975 | Kiser . |
| 4,928,860 | * | 5/1990 | Knight ..... 222/466 |
| 4,998,647 | * | 3/1991 | Sharp ..... 222/181.2 |
| 5,213,236 | * | 5/1993 | Brown et al. ..... 222/494 |
| 5,320,231 | * | 6/1994 | Iodice ..... 215/100 |
| 5,409,144 | | 4/1995 | Brown . |
| 5,660,301 | | 8/1997 | Kaplowitz . |
| 5,749,497 | | 5/1998 | Davis . |
| 5,819,984 | | 10/1998 | Krueger . |

* cited by examiner

*Primary Examiner*—Joseph A. Kaufman
(74) *Attorney, Agent, or Firm*—Rockey, Milnamow & Katz, Ltd.

(57) ABSTRACT

A container is provided for being supported from a rod. The container includes a dispensing end portion defining an opening through which a fluid product can be dispensed from the container interior. The end portion defines a dispensing chamber for holding at least some of the fluid product when the container is disposed with the dispensing end portion hanging downwardly. Two extension portions extend from the dispensing end portion. Each extension portion defines an extension chamber for communicating with the dispensing chamber and for holding some of the product. Each extension portion has at least one projecting portion projecting generally toward a projecting portion of the other extension portion to define a rod-receiving cavity between the extension portions below the projecting portions. The extension portions are each sufficiently flexible to accommodate temporary deflection away from each other as the projecting portions are forced against the rod so that the rod is received in the rod-receiving cavity. The extension portions are sufficiently resilient to return to a less stressed condition closer to each other so as to engage the rod whereby the container hangs from the rod.

11 Claims, 4 Drawing Sheets

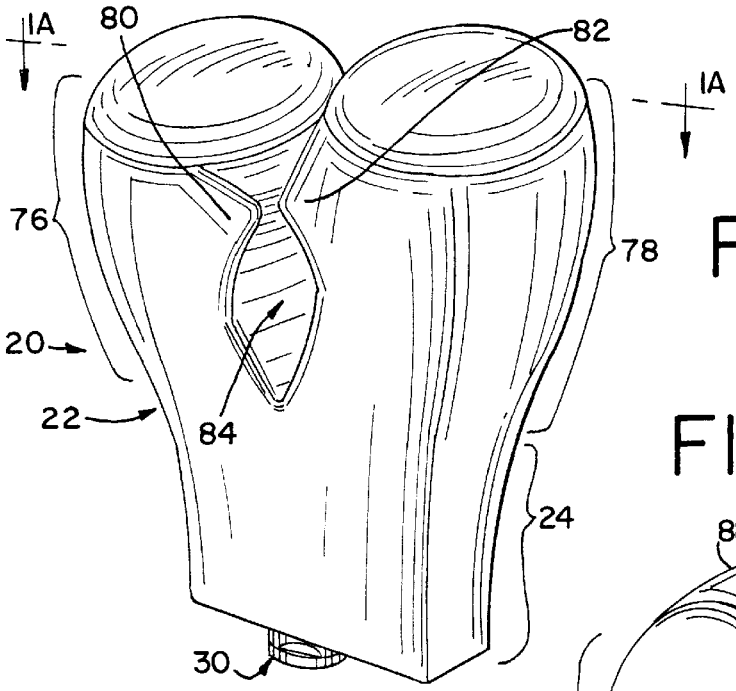
FIG. 1
FIG. 1A
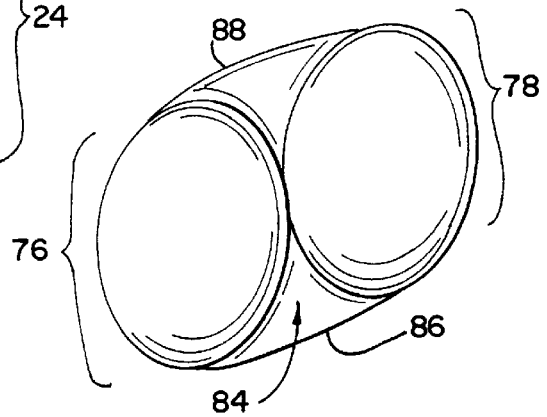
FIG. 2
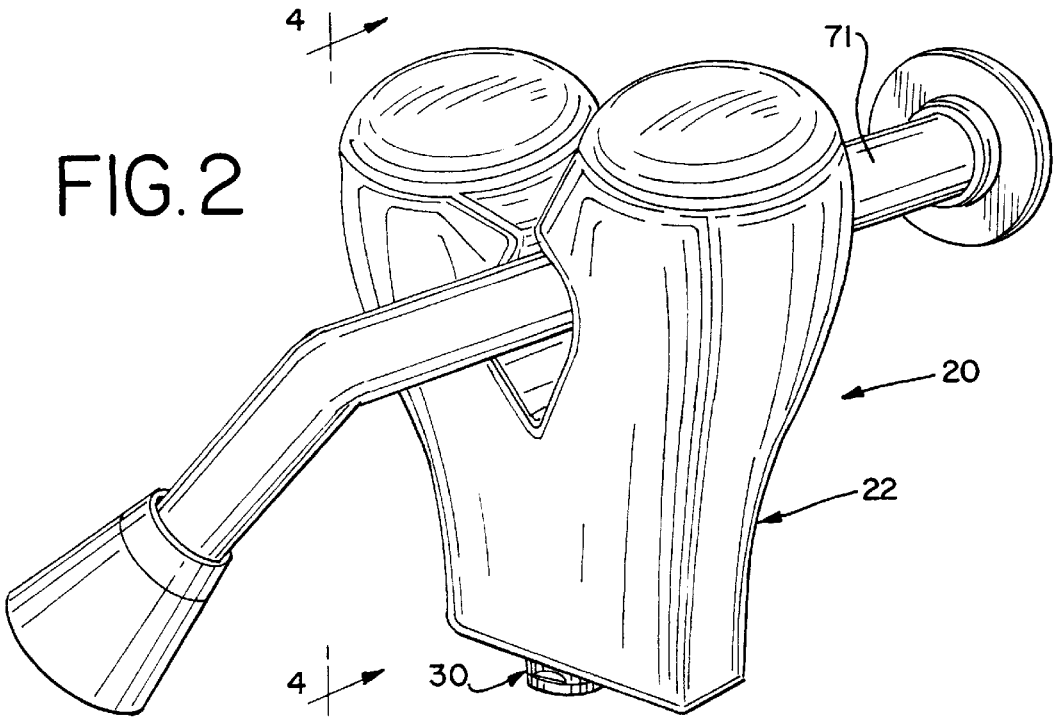

220
282
296
284
294
280
71
285
276
224
222
230

378
324
396
382
380
394
401
482
582
402
483
403
501
502
503
583
376
278
384
322
326

320
384
322
331
340
330

ROD-SUPPORTABLE HANGING CONTAINER

CROSS REFERENCE TO RELATED APPLICATION(S)

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

TECHNICAL FIELD

This invention relates to containers or packages which can be suspended. The invention is particularly suitable for incorporation in a dispensing container which can be stored and used in an inverted position.

BACKGROUND OF THE INVENTION AND TECHNICAL PROBLEMS POSED BY THE PRIOR ART

A variety of packages, including dispensing containers, have been developed for personal care products such as shampoos, lotions, etc., as well as for other materials. Such packages typically include a squeezable, resilient container with a dispensing aperture. The container may have a body with a unitary end wall defining the dispensing aperture. Alternatively, the container may have a closure mounted to the container body over the mouth of the container body, and the closure has an end wall defining the dispensing aperture. The closure also typically has a hinged lid, or other closing system, that is movable between open and closed positions.

One type of dispensing system for these kinds of packages typically includes a flexible, pressure-openable, self-sealing, slit-type dispensing valve which can be mounted either directly in the container body or in a separate closure over the container body mouth. A secondary closing system or member, such as a hinged lid, may also be provided adjacent the valve. When the secondary closing system is opened and the container is squeezed, the container internal pressure increases, the valve slits open, and the fluid contents of the container are discharged through the open slits of the valve. The valve automatically closes to shut off fluid flow therethrough upon removal of the increased pressure.

Designs of such valves are disclosed in the U.S. Pat. Nos. 5,409,144, 5,439,143 and 5,839,614. Designs of containers with body openings for receiving such valves directly are disclosed in U.S. Pat. Nos. 5,409,144 and 5,439,143. Designs of separate closures using such valves are illustrated in the U.S. Pat. Nos. 5,531,363, 5,839,626, and 5,680,969. The illustrated closures each typically include a body or base mounted on the container to hold the valve over the container mouth.

Because the self-sealing dispensing valve in container or closure remains closed unless the container is squeezed, the lid or other closing system on the container or closure can be moved to an open position, and the opened container can be stored on a counter or shelf in an inverted position (with the dispensing valve at the bottom). The fluid product does not leak through such a valve, and there is virtually no product residue on the exterior of the valve or surrounding container surfaces.

It would be desirable to provide a system for hanging such a container in the inverted position. In such a hanging position, the product would flow under the influence of gravity to the dispensing valve. Thus, the product could be quickly squeezed out of the container without having to wait for a sufficient quantity of product to be squeezed toward the dispensing end of the container.

The U.S. Pat. No. 5,409,144 discloses (with reference to FIG. 17 therein) a dispensing package with a hook for hanging the package. The hook projects from the end of the package. Accommodation must be made for the projecting hook during shipping and storage. Further, care must be taken to avoid accidentally snagging the hook when handling the package.

It would also be beneficial if a container could incorporate a hanging system in a way that would minimize projecting components or parts that must be manipulated by the user, or that could snag on the user's clothing or other objects, and/or that could be easily damaged.

Such an improved container should also accommodate designs which permit incorporation of a dispensing structure as a unitary part, or extension, of the bottom end of the container when it is suspended, and such an improved container should also accommodate designs that separately mount the dispensing structure on the container in a secure manner.

It would also be beneficial if such an improved container could readily accommodate its manufacture from a variety of different materials.

Further, it would be desirable if such an improved container could be provided with a design that would accommodate efficient, high-quality, large volume manufacturing techniques with a reduced product reject rate.

Preferably, the improved container should also accommodate its production with high-speed manufacturing techniques that produce consistent operating characteristics unit-to-unit with high reliability.

The present invention provides an improved container which can accommodate designs having the above-discussed benefits and features.

The present invention provides an improved package which can accommodate designs having the above-discussed benefits and features.

SUMMARY OF THE INVENTION

According to one aspect of the present invention, an improved container is provided for dispensing a fluid product while in a suspended orientation.

The container includes a dispensing end portion defining an opening through which a fluid product can be dispensed from the container interior. The container is adapted to be supported from a rod, such as a shower curtain rod or a shower head pipe that projects from the wall of a shower. The container may have a unitary or separate dispensing structure at the end. In the preferred form, the dispensing structure defines a dispensing aperture which establishes communication between the interior and exterior of the container. In the preferred embodiment, the container includes a neck having a mouth defining an opening, and a smaller dispensing aperture is incorporated in a separate closure which is mounted over the opening at the mouth of the container. A pressure-openable, self-sealing, slit type dispensing valve is preferably mounted in the closure across the smaller dispensing aperture.

The container end portion defines a dispensing chamber for holding at least some of the fluid product when the container is disposed with the dispensing end portion hanging downwardly. Two extension portions extend from the dispensing end portion.

Each extension portion defines an extension chamber. Each extension chamber communicates with the dispensing chamber and is adapted to hold some of the fluid product. Each extension portion has at least one projecting portion projecting generally toward a projecting portion of the other extension portion to define a rod-receiving cavity between the extension portions below the projecting portions. The extension portions are each sufficiently flexible to accommodate temporary deflection away from each other as the projecting portions are forced against the rod so that the rod is received in the rod-receiving cavity. The extension portions are sufficiently resilient to return from the deflected positions to a less stressed condition closer to each other so as to engage the rod whereby the container hangs from the rod.

Numerous other advantages and features of the present invention with become readily apparent from the following detailed description of the invention, from the claims, and from the accompanying drawings.

BRIEF DESCRIPTION OF THE DRAWINGS

In the accompanying drawings that form part of the specification, in which like numerals are employed to designate like parts throughout the same, FIG. 1 is a perspective view of a first embodiment of a package which includes a liquid product in an inverted container of the present invention and a closure mounted thereon with the lid closed;

FIG. 1A is a view taken generally along the plan 1A—1A in FIG. 1;

FIG. 2 is a perspective view of the package shown mounted on a shower head;

DESCRIPTION OF THE PREFERRED EMBODIMENTS

Figure 4:
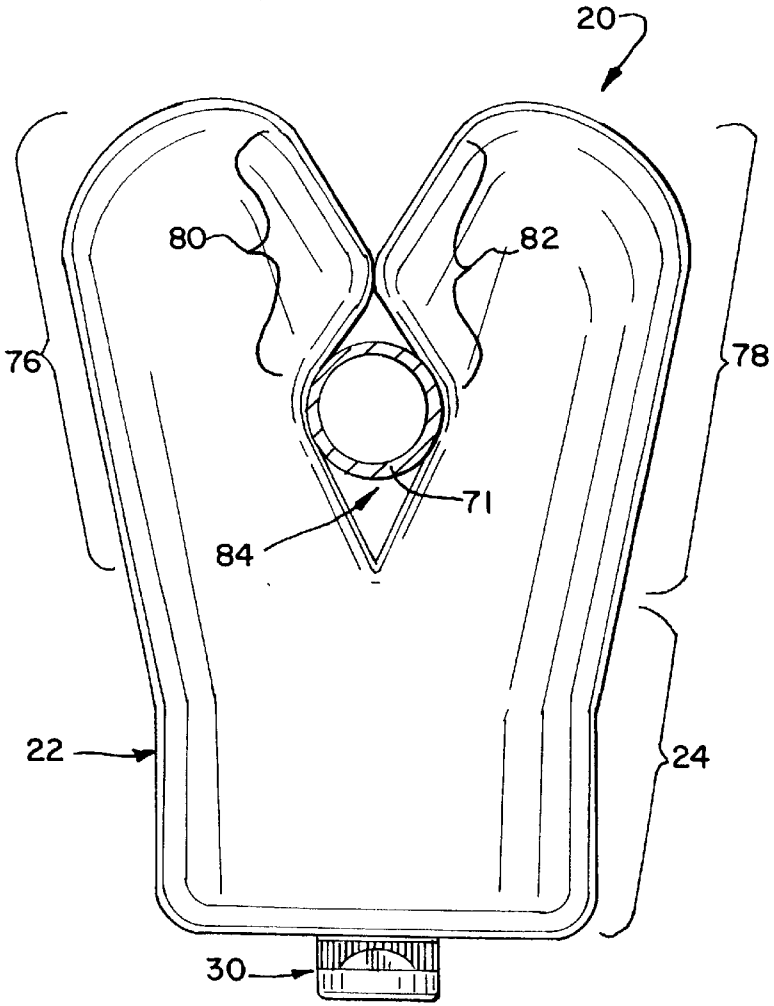
FIG. 4 is a cross-sectional view taken generally along the plan 4—4 in FIG. 2 showing the package mounted on the shower head.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For the ease of description, the package components of this invention are described in various positions, and terms of such as upper, lower, horizontal, etc., are used with reference to these positions. It will be understood, however, that the components may be manufactured and stored in orientations other than the ones described.

With reference to the figures, a package that includes a first embodiment of a container of the present invention is illustrated in FIGS. 1–6 and is represented generally in those figures by reference numeral 20. The first embodiment of the package 20 includes a container 22.

Figure 6:
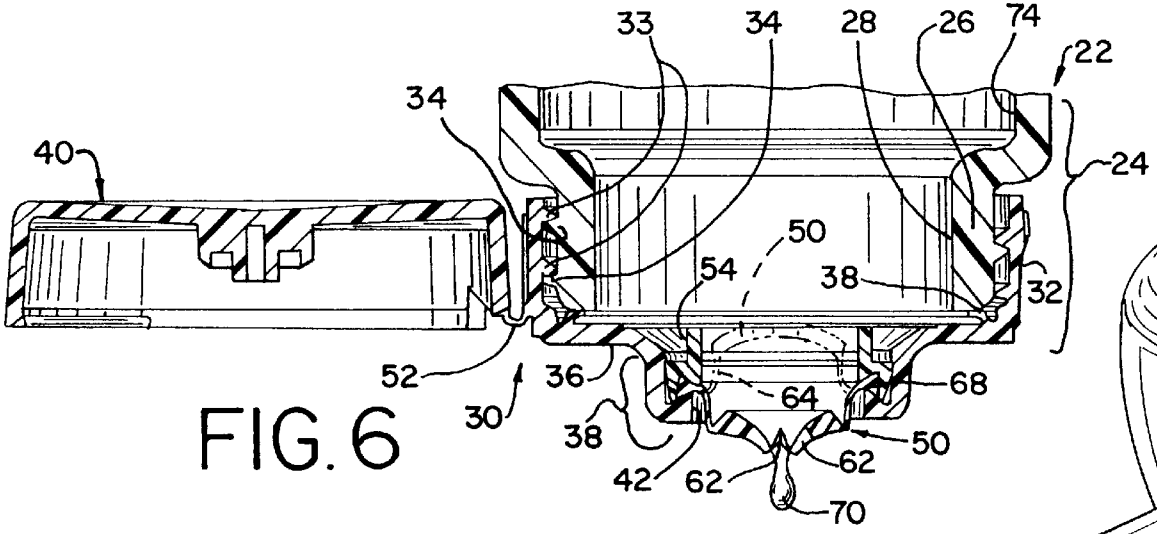
FIG. 6 is a greatly enlarged, fragmentary view of the closure which is mounted on the container shown in FIGS. 1–5 and which is shown with the lid open and with product being dispensed from the closure.

The container 22 has a dispensing end portion, which in the preferred embodiment, has a conventional mouth at a reduced diameter neck 26 defining an opening 28 as shown in FIG. 6. A separate closure 30 is mounted on the container neck 26. The closure 30 includes a skirt 32 extending around the end of the container neck 26. The container neck 26 may have a suitable connecting means, such as a conventional thread 33 or a conventional snap-fit bead or groove (not illustrated) for engaging a suitable closure skirt cooperating means, such as a thread 34 or a conventional snap-fit groove or bead (not shown) to secure the container 22 to the closure 30. The closure 30 and container 22 could alternatively be fixed together by an induction melt weld, ultrasonic melt weld, adhesive, or the like.

Alternatively, the closure 30 may be formed as an extension or unitary part of the container by appropriate molding techniques. The particular structure of the distal end of the container 22, whether formed as a unitary structure or as a neck 26 and separate closure 30 as illustrated, is a matter of design choice. If a separate closure 30 is provided, the detailed design of such a closure 30, and of the structure of the means for attaching the closure 30 to the container 22, forms no part of the present invention.

The distal end of the container 22, whether formed as part of the dispensing end 24 of the container 22 per se or whether defined by a separate closure 30, has a dispensing aperture. In the embodiment illustrated in FIGS. 1–6 wherein the separate closure 30 is employed, the closure 30 defines a dispensing aperture adjacent the container neck opening 28 as described in detail hereinafter.

At the end of the closure skirt 32, the closure 30 defines a radially inwardly extending, annular deck or shoulder 36 (FIG. 6). Preferably, as can be seen in FIG. 6, an annular, flexible "crab's claw", shaped seal 38 projects inwardly from the inside of the closure shoulder 36 adjacent the end of the container neck 26 so as to provide a leak-tight seal between the closure 30 and the container neck 26. Of course, other types of closure container seals may be employed.

A spout 38 projects outwardly (i.e., downwardly in FIG. 6) from the closure deck or shoulder 36. The spout 38 has an open distal end which can be closed by a lid 40. The spout 38 defines a dispensing opening or aperture 42 for establishing communication between the exterior and interior of the container 22 and for receiving a flexible, pressure-openable, self-closing, slit valve 50 (FIG. 6).

The lid 40, when closed, functions as a cover. The lid 40 may be characterized as a secondary closure system, relative to a primary closing system represented by the self-closing valve. The lid 40 prevents unintended discharge from the container 22 through the pressure-openable valve, which discharge could result from the container being subjected to high impact forces during shipping of the container, during warehousing, and while the container is on display in a store, or while a container is initially being handled or stored by a user.

The lid 40 is preferably hingedly connected to the skirt 32 of the closure 30 with a snap-action hinge 52 (FIG. 6). Such a hinge is disclosed in the U.S. Pat. No. 5,642,824, the disclosure of which is incorporated herein by reference thereto. In an alternate embodiment, the lid 40 need not be connected with a snap-action hinge. A floppy hinge may be used instead. Further, in another embodiment (not illustrated), no hinge at all need be employed. The lid could be completely separate, and completely removable, from the closure body. In some applications, it may be desirable to eliminate the lid altogether.

The valve 50 is adapted to be held against the inside of the spout 38 by a retaining ring 54 (FIG. 6). As shown in FIG. 6, the retaining ring 54 is mounted in the spout 38 in a snap-fit engagement. The inside of the spout 38 and the retaining ring 54 include angled clamping surfaces for engaging a peripheral portion of the valve 50 and holding the valve 50 tight in the closure 30.

In the preferred form of the valve 50 illustrated, the valve 50 is of a known design employing a flexible, resilient material, which can open to dispense fluid. The valve 50 may be fabricated from thermosetting elastomeric materials such as silicone, natural rubber, and the like. It is also contemplated that the valve 50 may be fabricated from thermoplastic elastomers based upon materials such as thermoplastic propylene, ethylene, urethane, and styrene, including their halogenated counterparts.

A valve which is similar to, and functionally analogous to, valve 50 is disclosed in the U.S. Pat. No. 5,409,144 with reference to valve 3*d* illustrated in FIGS. 26–29 of the U.S. Pat. No. 5,409,144. The description of the valve 3*d* disclosed in the U.S. Pat. No. 5,409,144 is incorporated herein by reference to the extent pertinent and to the extent not inconsistent herewith.

As illustrated in FIG. 6, the valve 50 is movable between a closed, rest position (shown in phantom with dashed lines) and an active, open position (shown in solid lines). The valve 50 includes a flexible, central portion, face, or head portion 60 which has an unactuated, concave configuration (when viewed from the exterior) and which defines two, mutually perpendicular, intersecting, dispensing slits 62 of equal length. The intersecting slits 62 define four, generally sector-shaped, flaps or petals in the concave, central, head portion 60. The flaps open outwardly from the intersection point of the slits 62, in response to increasing container pressure of sufficient magnitude, in the well-known manner described in the U.S. Pat. No. 5,409,144.

The valve 50 includes a skirt or sleeve 64 which extends from the valve central wall or head portion 60. At the outer end of the sleeve 64, the sleeve 64 merges with an enlarged, much thicker, peripheral flange 68 which has a generally dovetail-shaped, transverse cross section (as viewed in FIG. 6).

To accommodate the seating of the valve 50 in the closure 30, the retaining ring 54 has a clamping or seating surface with a frustoconical configuration at the same angle as the angle of the adjacent surface of the valve flange dovetail configuration.

Similarly, the other surface of the valve flange 68 is clamped by the inside of the spout 38 which has a frustoconical configuration at an angle which matches the angle of the adjacent surface of the valve flange dovetail configuration.

This arrangement securely clamps and holds the valve 50 without requiring special internal support structures or bearing members adjacent the interior surface of the valve cylindrical sleeve 64. This permits the region adjacent the interior surface of the valve cylindrical sleeve 64 to be substantially open, free, and clear so as to accommodate movement of the valve sleeve 64 as described hereinafter.

If desired, the valve 50 could be retained in the closure 30 without the retaining ring 54. For example, the valve 50 could be bonded to the closure 30 with adhesive or could be directly molded onto the closure 30 so as to create a weld defined by interface solidification of melted portions of the materials.

The valve 50 could be molded with the slits 62. Alternatively, the valve slits 62 could be subsequently cut into the central head portion 60 of the valve 50 by suitable conventional techniques.

When the valve 50 is properly mounted within the closure lid 30 as illustrated in dashed lines in FIG. 6, the central head portion 60 of the valve 50 lies recessed within the closure 30. However, when the container 22 is squeezed to dispense the contents through the valve 50, then the valve head portion 60 is forced outwardly from its recessed position toward the end of the closure 30.

In use, the lid 40 on the closure 30 is first opened. Then the container 22 is inverted and squeezed to increase the pressure within the container 22 above the ambient exterior atmospheric pressure. This forces the product within the container toward the valve 50 and forces the valve 50 from the recessed or retracted position toward the outwardly extending position (shown in solid lines in FIG. 6). The outward displacement of the central head portion 60 of the valve 50 is accommodated by the relatively, thin, flexible, sleeve 64. The sleeve 64 moves from an inwardly projecting, rest position (shown in phantom by dashed lines in FIG. 6) to an outwardly displaced, pressurized position, and this occurs by the sleeve 64 "rolling" along itself outwardly toward the outside of the closure 30 (toward the position shown in solid lines in FIG. 6). However, the valve 50 does not open (i.e., the slits 62 do not open) until the valve central head portion 60 has moved substantially all the way to a fully extended position beyond the dispensing aperture 42. Indeed, as the valve head portion 60 begins to move outwardly, the valve head portion 60 is initially subjected to radially inwardly directed compression forces which tend to further resist opening of the slits 62. Also, the valve central head portion 60 generally retains its inwardly concave configuration as it moves outwardly and even after it reaches the fully extended position. However, when the internal pressure becomes sufficiently high after the valve central head portion 60 has moved outwardly to the fully extended position, then the slits 62 of the valve 50 open to dispense product (FIG. 6). The product is then expelled or discharged through the open slits 62. For illustrative purposes, FIG. 6 shows a drop 70 of a liquid product being discharged.

When the squeezing pressure on the container 22 is released, the valve 50 closes, and the valve head 60 retracts to its recessed, rest position within the closure 30. The weight of the product on the valve 50 does not cause the valve to open or to remain open if the container is not being squeezed.

The valve 50 is a desirable feature, but it need not be employed. The closure 30, or other container end structure, could instead merely have a suitable dispensing aperture with a suitable, simple closing system (e.g., lid, pivotable spout, etc.). The details of the particular dispensing system form no part of the present invention.

Figure 5:
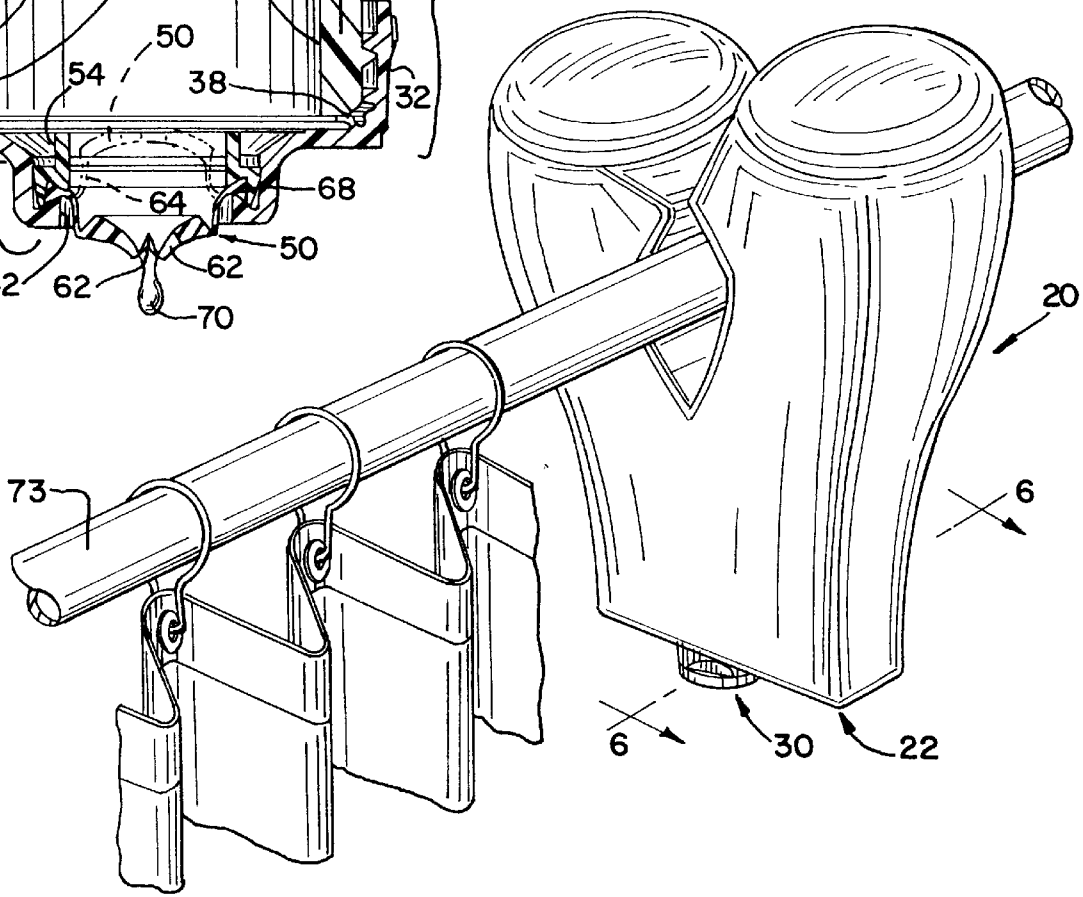
FIG. 5 shows the package of the present invention mounted on a shower curtain rod.

The container 22 has a novel configuration which permits it to be hung or suspended from a rod, such as a shower head pipe 71 as shown in FIG. 2 or a shower curtain rod 73 as shown in FIG. 5. In particular, with reference FIGS. 1 and 6, the dispensing end 24 of the container 22 defines an internal dispensing chamber 74 (FIG. 6) for holding at least some of the fluid product when the container 22 is disposed with the dispensing end 24 hanging downwardly. Two extension portions 76 and 78 (FIG. 1) extend from the dispensing end portion 24. Each extension portion 76 and 78 is hollow and defines an interior extension chamber (not visible in FIG. 1). Each extension chamber communicates with the dispensing chamber 74 and is adapted to hold some of the fluid product.

Figure 3:
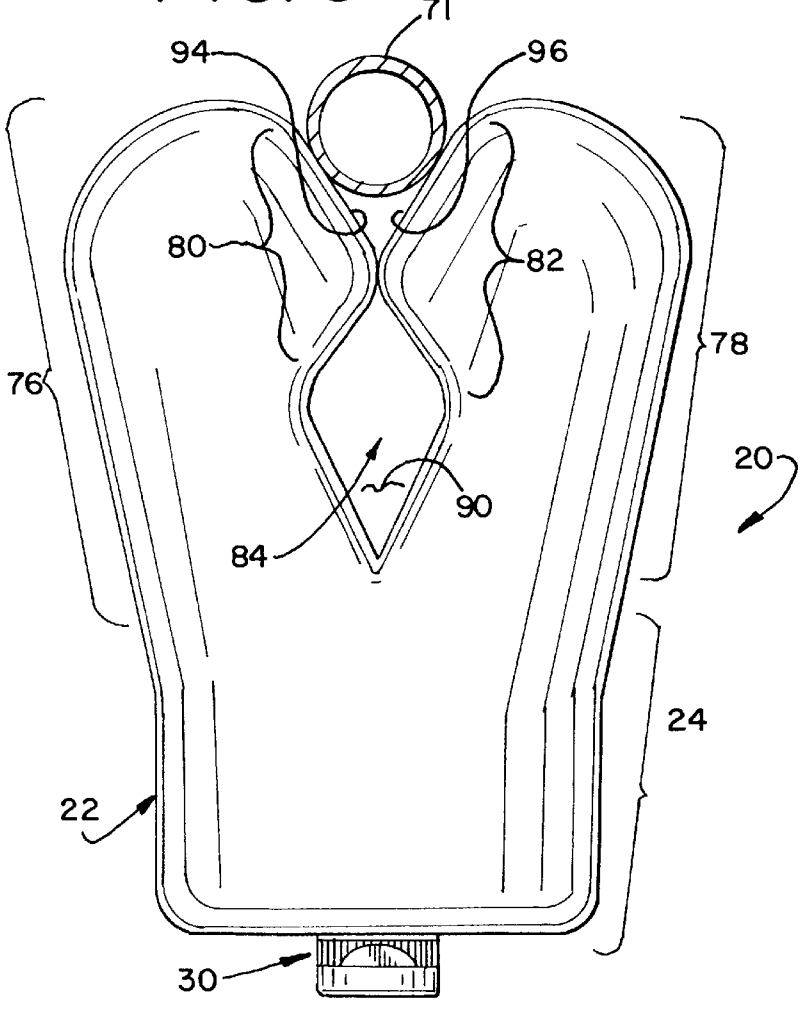
FIG. 3 is a side elevational view of the package being positioned for mounting on a shower head.

As can be seen in FIG. 3, the extension portion 76 has a projecting portion 80, and the extension portion 78 has a projecting portion 82. Each projecting portion 80 and 82 projects generally toward the other projecting portion to define a rod-receiving cavity 84 between the extension portions 76 and 78 below the projecting portions 80 and 82.

As shown in FIGS. 1 and 1A, the upper part of the extension portion 76 and its projecting portion 80 are partially, laterally offset relative to the upper part of the extension portion 78 and its projecting portion 82. As manufactured, and as filled with a fluid product, the container 22 has a configuration such that the projecting portions 80 and 82 just touch or nearly touch. Each of the extension portions 76 and 78 has generally the same shape and size. Preferably, the container 22 is molded from a thermoplastic material (e.g., polyethylene, polypropylene or other polymer material) with a suitable wall thickness so that the container configuration has some degree of flexibility and resiliency.

Preferably, the container 22 has two, generally oppositely facing sides 86 and 88 (FIG. 1A), and the cavity 84 extends between the sides 86 and 88. The cavity 84 is open at each side 86 and 88. The cavity 84, when viewed from an open side (such as when viewed from the open side 86 in FIG. 3), has a lower region 90 defining an acute angle.

Preferably, as shown in FIG. 3, the projecting portion 80 defines an upper surface 94 extending in a direction upwardly and outwardly from the cavity 84. Similarly, the projecting portion 82 defines an upper surface 96 extending in a direction upwardly and outwardly from the cavity 84. The surfaces 94 and 96 are adapted to engage the bottom peripheral portion of a shower head pipe or shower curtain rod as the container 22 is mounted by the user on the pipe or rod.

The extension portions 76 and 78 are each sufficiently flexible to accommodate temporary deflection away from each other as the projecting portions 80 and 82 are forced against the shower head pipe 71 (FIGS. 2, 3, and 43) or shower curtain rod 73 (FIG. 5). The extension portions 76 and 78 are each sufficiently flexible to accommodate temporary deflection away from each other as the projecting portions are forced against the shower pipe or other rod so that the pipe or other rod is received in the rod-receiving cavity 84. The extension portions 76 and 78 are sufficiently resilient to return from the outwardly deflected positions to a less stressed condition closer to each other so as to engage the shower head pipe or other rod so that the container hangs from the pipe or other rod (FIGS. 2, 4, and 5). In the first embodiment illustrated in FIGS. 1–6, the extension portions 76 and 78 are sufficiently resilient so as to return all the way to the original configuration, wherein the projecting portions 80 and 82 touch or just barely meet, as shown in FIG. 4.

Figures 7, 8, 9:
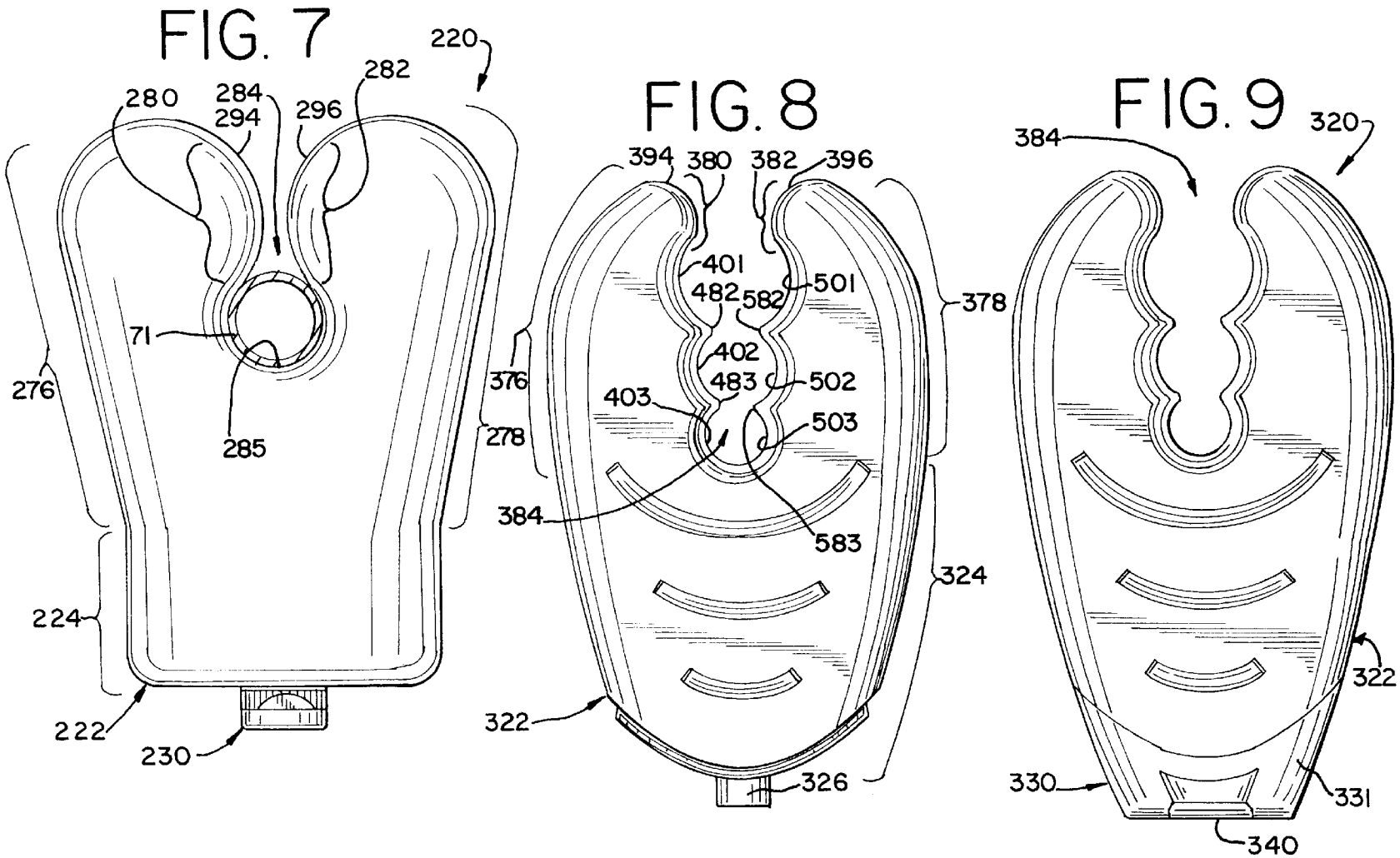
FIG. 7 is a side elevational view of another package which includes a second embodiment of the container of the present invention.
FIG. 8 is a side elevational view of a third embodiment of a container of the present invention without a closure.
FIG. 9 is a side elevational view of the third embodiment of the container with a closure installed thereon.

A second embodiment of the package of the present invention is illustrated in FIG. 7 wherein the package is designated generally by the reference numeral 220. The package 220 has a structure that is similar to that described above for the structure of the package 20 illustrated in FIGS. 1–6. The package 220 includes a container 222 having a dispensing end portion 224 which includes a closure 230. The dispensing end portion 224 and closure 230 may be substantially identical with the dispensing end portion 24 and closure 30, respectively, described above with reference to the first embodiment of the package 20 illustrated in FIGS. 1–6.

The container 222 includes two extension portions 276 and 278. The extension portions 276 and 278, and the dispensing end portion 224 are hollow and define interior chambers which communicate with each other and with the dispensing closure 230. The extension portion 276 has a projecting portion 280, and the extension portion 278 has a projecting portion 282. In the "as-manufactured" configuration of the container 222, the projecting portions 280 and 282 are spaced apart, both when the container is supported on a rod (e.g., shower head pipe or rod 71 as shown in FIG. 7, or a shower curtain rod) as well as when the container 222 is not supported on such a rod. Nevertheless, the projecting portions 280 and 282 project generally toward each other to define a rod-receiving cavity 284 below the projecting portions.

In the second embodiment illustrated in FIG. 7, the extension portion 276, along with its projecting portion 280, has generally the same shaped and size as the extension portion 278 and its associated projecting portion 282. The rod-receiving cavity 284 has a lower region 285 defining an arcuate shape for receiving the bottom peripheral portion of the rod 71. Indeed, a substantial portion of the periphery of the cavity 284, as viewed in FIG. 7, has a generally circular arc configuration for receiving a pipe or other rod having a generally circular cross-sectional shape. As with the first embodiment described above with reference to FIGS. 1–6, the rod-receiving cavity 284 in the second embodiment extends between oppositely facing sides of the container 222 and is open at each side.

Preferably, the projecting portion 280 defines an upper surface 294 extending in a direction upwardly and outwardly from the cavity 284, and the projecting portion 282 defines an upper surface 296 extending in a direction upwardly and outwardly from the cavity 284. The upper surfaces 294 and 296 are adapted to initially engage the bottom surface of the shower head pipe or other rod 71 as the container 222 is pushed upwardly against the rod. The container extension portions 276 and 278 are each sufficiently flexible to accommodate temporary deflection away from each other as the projecting portions 280 and 282 are forced against the rod 71 so that the rod 71 is received in the rod-receiving cavity 284. The extension portions 276 and 278 are sufficiently resilient to return to a less stressed condition closer to each other so as to engage the rod 71 whereby the container 222 hangs from the rod 71.

A third embodiment of the package of the present invention is illustrated in FIG. 9 wherein the package is designated generally by the reference numeral 320 and comprises a closure 330 on a container 322 (shown separately without the closure in FIG. 8). The package 320 has a structure that is somewhat similar to that described above for the structures of the first and second embodiments of the package illustrated in FIGS. 1–7.

As shown in FIG. 8, the container 322 includes a dispensing end portion 324 having a neck 326. The neck 326 defines an opening (not visible in FIG. 8) through which fluid product can be dispensed from the container interior. The dispensing end portion 324 is adapted to receive the closure 330 in a snap-fit engagement. The closure 330 includes a closure body 331 and a closure lid 340 which is hinged to the closure body 331. The interior of the closure body 331 preferably includes a pressure-openable, self-sealing, flexible, slit-type valve (not visible, but substantially identical with the valve 50 described above with reference to the first embodiment illustrated in FIG. 6).

With reference to FIG. 8, container 322 includes a first extension portion 376 and a second extension portion 378. The extension portions 376 and 378 each extend from the dispensing end portion 324. The dispensing end portion 324 is hollow, as are the extension portions 376 and 378. The dispensing end portion 324 may thus be characterized as defining an internal dispensing chamber, and the extension portions 376 and 378 may be characterized as each defining an extension chamber for communicating with the dispensing chamber.

The extension portion 376 has a first projecting portion 380, and the extension portion 378 has a first projecting portion 382. Each projecting portion 380 and 382 extends or projects toward the other projecting portion to define a rod-receiving cavity 384 between the extension portions 376 and 378 below the projecting portions 380 and 382.

In the embodiment illustrated in FIGS. 8 and 9, the rod-receiving cavity 384 actually consists of three, vertically spaced, rod-receiving regions, with each region being of a different size for accommodating a different range of rod sizes. Specifically, the extension portion 376 defines (1) a first circular arc-receiving surface 401 along an upper portion of the rod-receiving cavity 384 (2) a second circular arc surface 402 along a middle portion of the cavity 384, and (3) a third circular arc-receiving surface 403 along a lower portion of the cavity 384. Similarly, the extension portion 378 defines (1) a first circular arc-receiving surface 501 along an upper portion of the cavity 384, (2) a second circular arc-receiving surface 502 along a middle portion of the cavity 384, and (3) a third circular arc-receiving surface 503 along a lower portion of the cavity 384. The first circular arc-receiving surfaces 401 and 501 face one another and are spaced apart by a first predetermined diameter or distance to engage a rod having a diameter in a range of the largest diameters that can be accommodated by the container 222. The second circular arc-receiving surfaces 402 and 502 face one another and are spaced apart by a second predetermined diameter or distance to engage a rod having a diameter within a smaller range than can be accommodated between the surfaces 401 and 501. The third circular arc-receiving surfaces 403 and 503 face one another and are spaced apart by a third predetermined diameter or distance to engage a rod having a third predetermined diameter within the smallest range of diameters that can be accommodated by the container 322. In the third embodiment illustrated in FIGS. 8 and 9, the second predetermined diameter or distance between the surfaces 402 and 502 is less than the first predetermined diameter or distance between the surfaces 401 and 501 but is greater than the third predetermined diameter or distance between the surfaces 403 and 503.

The third embodiment of the container 322 illustrated in FIG. 8 may be characterized as having a set of second projecting portions—a second projecting portion 482 on the extension portion 376, and a second projecting portion 582 on the extension portion 378. Similarly, the extension portions 376 and 378 may be characterized as each also having a set of third projecting portions—a third projecting portion 483 projecting from the extension portion 376, and a third projecting portion 583 projecting from the extension portion 378.

The extension portions 376 and 378 are sufficiently flexible to accommodate temporary deflection away from each other as the projecting portions are forced against a rod so that the rod is received in the appropriate region of the rod-receiving cavity 384. The extension portions 376 and 378 are also sufficiently resilient so as to return from the deflected positions to a less stressed condition closer to each other after the rod has been positioned in the appropriate region of the rod-receiving cavity 384 whereby the extension portions are again closer to each other so as to engage the rod and suspend the container from the rod.

Preferably, at the upper end of the container 322, the projecting portion 380 defines an upper surface 394 extending in a direction upwardly and outwardly from the cavity 384. Similarly, on the other side of the cavity 384, the projecting portion 382 defines an upper surface 396 extending in a direction upwardly and outwardly away from the cavity 384. These surfaces 394 and 396 are adapted to engage the bottom periphery of the largest size rod that is intended to be accommodated in the rod-receiving cavity 384 between the first arcuate surface 401 and the second arcuate surface 501. An intermediate size rod would engage the projecting portions 482 and 582 to spread the extension portions 376 and 378 apart as the container 322 is moved upwardly into position on such an intermediate size rod. The smallest size rod that could be accommodated by the container 322 would engage the projecting portions 483 and 583 to spread the extension portions 376 and 378 apart as the container 322 is moved upwardly against the smallest size rod to hang the container 322 from the rod.

The container of the present invention thus provides a convenient method for storing and using a fluid product. The container maintains the desired position, hanging downwardly for ready dispensing of the fluid products. The container can be attached to various size mating components, especially pipes or other rods. The rods need not have circular cross sections. The rods may have other curved cross sections (e.g., oval), or polygon cross sections, or combinations of curved and polygon cross sections.

The container is readily adapted for employing a pressure-openable, self-closing, flexible, slit-type valve. However, other dispensing structures, including structures without a valve per se, may be employed.

The container is especially suitable for the storage and dispensing of personal care products such as shampoo, but the container of the present invention is not limited to use with such products.

While the nature of the rod-receiving cavity and resilient properties of the container function to hold the container to the rod even when the container is completely full of a liquid product, the container can be removed from the rod by the user if sufficient downward force is exerted on the container so as to pull the container out of engagement with the rod. Thus, the container can be readily transferred from one site to another.

If the container is provided with the pressure-openable, self-closing, flexible, slit-type valve, such as the valve 50 described herein, then the fluid product can be readily dispensed from the container on demand by merely squeezing the container as it hangs from the supporting rod. There is no need to subsequently reseal the container by closing a lid. Indeed, in some applications, it may not be necessary to provide a lid with the container.

It will be readily observed from the foregoing detailed description of the invention and from the illustrations thereof that numerous other variations and modifications may be effected without departing from the true spirit and scope of the concepts or principles of this invention.

What is claimed is:

1. A container for being supported from a rod, said container comprising:

a dispensing end portion defining an opening through which a fluid product can be dispensed from the container interior, said end portion defining a dispensing chamber for holding at least some of said fluid product when said container is disposed with said dispensing end portion hanging downwardly; and two extension portions extending from said dispensing end portion, each said extension portion defining an extension chamber for communicating with said dispensing chamber and for holding some of said product, each said extension portion having at least one projecting portion projecting generally toward a projecting portion of the other extension portion to define a rod-receiving cavity between said extension portions below said projecting portions, said extension portions each being sufficiently flexible to accommodate temporary deflection away from each other as said projecting portions are forced against said rod so that said rod is received in said rod-receiving cavity, said extension portions being sufficiently resilient to return from the deflected positions to a less stressed condition closer to each other so as to engage said rod whereby said container hangs from said rod.

2. The container in accordance with claim 1 further including a closure mounted to said dispensing end portion over said opening, said closure including (1) a spout defining a dispensing aperture communicating with said opening, and (2) a normally closed, pressure-openable, flexible, self-sealing, slit valve mounted across said dispensing aperture.

3. The container in accordance with claim 1 in which said projecting portions are spaced apart both when the container is supported on said rod and when the container is not supported on said rod.

4. The container in accordance with claim 1 in which said projecting portions touch when said container is filled with product.

5. The container in accordance with claim 1 in which each of said projecting portions is partially laterally offset relative to the other of said projecting portions.

6. The container in accordance with claim 1 in which said extension portions each has generally the same shape and size.

7. The container in accordance with claim 1 in which said container has two, generally oppositely facing sides;

said cavity extends between said sides and opens at each said side; and said cavity, when viewed from an open side, has a lower region defining an acute angle.

8. The container in accordance with claim 1 in which said container has two, generally oppositely facing sides;

said cavity extends between said sides and opens at each said side; and said cavity, when viewed from an open side, has a lower region defining an arcuate shape for receiving said rod.

9. The container in accordance with claim 1 in which each said extension portion defines (1) a first circular arc receiving surface along a portion of said cavity, (2) a second circular arc receiving surface along a portion of said cavity, and (3) a third circular arc receiving surface along a portion of said cavity; and said first circular arc receiving surfaces face one another and are spaced apart by a first predetermined distance to engage said rod having a first predetermined diameter, said second circular arc receiving surfaces of said extension portions face one another and are spaced apart by a second predetermined distance to engage said rod having a second predetermined diameter, and said third circular arc receiving surfaces of said extension portions face one another and are spaced apart by a third predetermined distance to engage said rod having a third predetermined diameter.

10. The container in accordance with claim 9 in which said second predetermined distance is less than said first predetermined distance and is greater than said third predetermined distance.

11. The container in accordance with claim 1 in which each said projecting portion defines an upper surface extending in a direction upwardly and outwardly from said cavity.

* * * * *